United States Patent [19]

Roberts

[11] Patent Number: 4,702,716

[45] Date of Patent: Oct. 27, 1987

[54] METHOD FOR ASSEMBLING ARC LAMP

[75] Inventor: Roy D. Roberts, Newark, Calif.

[73] Assignee: ILC Technology, Inc., Sunnyvale, Calif.

[21] Appl. No.: 1,183

[22] Filed: Jan. 7, 1987

Related U.S. Application Data

[62] Division of Ser. No. 735,817, May 17, 1985.

[51] Int. Cl.[4] ..... H01J 5/16
[52] U.S. Cl. ..... 445/26
[58] Field of Search ..... 445/26; 313/112, 113

[56] References Cited

U.S. PATENT DOCUMENTS 3,495,118 2/1970 Richter ..... 313/113
3,731,133 5/1973 McRae et al. ..... 445/26 X

*Primary Examiner*—Kenneth J. Ramsey
*Attorney, Agent, or Firm*—Thomas E. Schatzel

[57] ABSTRACT

A short arc lamp includes a window assembly which can be fitted together and secured to a hollow cylindrical body member of the lamp in a single braze. The window assembly includes a transparent window, a tubular cowling member, a retaining ring and struts for supporting a cathode within the lamp. The lamp further includes a hollow concave reflecting shell which is held in place within the first body member by a second hollow cylindrical body member and a dielectric spacer ring.

1 Claim, 3 Drawing Figures

METHOD FOR ASSEMBLING ARC LAMP

This is a of co-pending application Ser. No. 735,817 filed on May 17, 1985.

BACKGROUND OF THE INVENTION

1. Field of the Invention

The present invention relates generally to arc lamps, and more particularly to the fabrication of arc lamps of the type which have short arc gaps.

2. Description of the Prior Art

In the prior art, it is well known to provide arc lamps which are quite compact to provide highly collimated beams of light for applications such as endoscopes. Typically, such lamps contain a pressurized inert gas at a pressure of several atmospheres, sometimes ten or more. Because of the pressurized gas and the fact that the lamps operate at relatively high wattages, such lamps must be carefully fabricated.

In the prior art designs, fabrication of such compact, short arc lamps was relatively expensive and time consuming, principally because the fabrication involved numerous brazing and welding steps. Such multiplicity of steps was necessary to provide proper alignment of the parts of the lamp and to ensure gastight sealing of the components in assembled condition. For example, in the prior art fabrication techniques, separate brazes or welds had to be accomplished for the cathode, the struts supporting the cathode, and the various other components comprising window assembly for the lamp.

SUMMARY OF THE INVENTION

A primary object of the present invention is to provide a lamp of the short arc type which can be more easily fabricated than prior art lamps.

A more specific object of the present invention is to provide a lamp of the short arc type which is simpler and less expensive to fabricate.

In accordance with the preceding objects, the present invention provides a lamp of the short arc type comprising a first hollow cylindrical body member; a disk-shaped base member for sealingly enclosing one end of the body section; a second hollow cylindrical body member dimensioned to fit flush concentrically within the first body member, said second body member having a radially inwardly tapered edge along its end opposite the base plate; a hollow concave reflecting shell dimensioned to fit within the first cylindrical body member with the periphery of the outer wall of the concave shell against said radially inwardly tapered edge of said second body member; the reflecting shell having an aperture formed centrally therein opposite its mouth; a first retaining ring member having an outside diameter substantially equal to the inside diameter of said first cylindrical body member, the retaining ring member being mounted within said first cylindrical body section at the end thereof opposite the base member to secure the reflecting shell concentrically in place; a circular window of diameter less than the outside diameter of the first cylindrical body member; an open-ended tubular cowling member having a smaller right cylindrical end to receive the circular window and a larger right cylindrical end to receive the end of the first cylindrical body member, said cowling member flaring radially outward between said smaller end and said larger end; a second retaining ring member which fits concentrically within said smaller end of said cowling member to sealing secure the circular window in place; strut means extending radially inward across the window to support a cathode member which extends axially into the hollow concave reflecting shell toward the focal point thereof; and an anode member mounted concentrically to the base member to extend axially through said central aperture in said reflecting shell to a location spaced adjacent the end of the cathode member at the focal point of the reflecting shell.

In accordance with the preceding, the present invention provides a lamp of the short arc type which can be more easily fabricated than prior art lamps.

More specifically, the present invention provides a lamp of the short arc type which is simplier and less expensive to fabricate than prior art devices.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
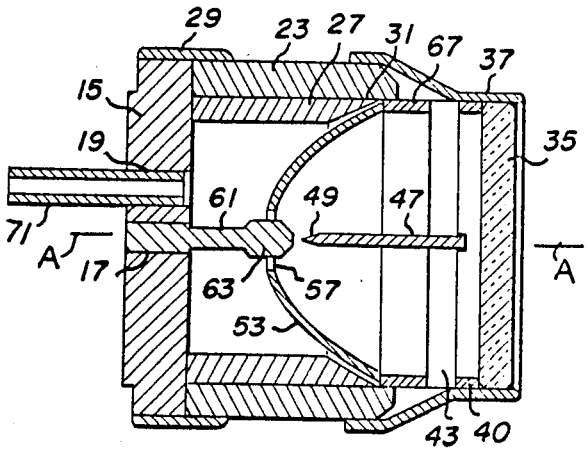
FIG. 1 is a side view, in axial section, of a lamp according to the present invention.
Figure 2:
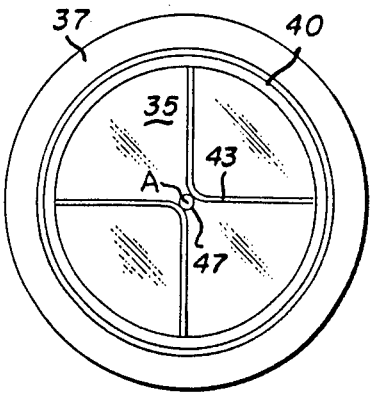
FIG. 2 is an end view of the lamp of FIG. 1.

FIGS. 1 and 2 illustrate a high intensity lamp, designated by the general reference character 10, of the type known in the prior art as a short arc lamp. The lamp 10 is generally symmetrical about a longitudinal central axis "A" and generally includes, a body section, a reflector assembly and a window assembly. Those four sections (i.e., the base section, the body section, the reflector assembly and the window assembly) are each circular in cross section and are sealingly secured to one another such that the lamp may contain gas pressurized to several atmospheres.

The base section comprises a disk-shaped base member 15 having a first aperture channel 17 formed centrally therethrough and a second aperture channel 19 formed therethrough at a location radially-offset from the central aperture channel 17. In practice, the base member 15 is formed of relatively pure iron to minimize offgassing of impurities during operation of the lamp. In practice, the base member typically has a diameter of several inches.

The body section of the lamp of the present invention includes a first (outer) hollow cylindrical body member 23 having opposite open ends. The outside diameter of the first cylindrical member 23 closely approximates the outside diameter of the disk-shaped base member 15. The body section further includes a second (inner) hollow cylindrical body member 27 which is dimensioned to fit flush concentrically within the first cylindrical body member 23. Both the first and second cylindrical body members have planar ends to fit flush against the interior face of the base member 15. In the preferred embodiment, the base member 15 is secured to the outer cylindrical body member by a circular band 29 which is positioned to overlappingly surround the periphery of the base member and the outer cylindrical body member 23.

In practice, both the outer cylindrical body member 23 and the inner cylindrical body member 27 are formed of a ceramic material such as alumina AD 94.5. This material is chosen for its relative purity, which minimizes outgassing during the operation of the lamp. In practice, the ceramic material is metallized so that metallic components may be readily attached thereto by brazine. Metallization may be accomplished, for example, by painting a mixture of molybdenum and manganese onto the body members and fixing that finish by firing at elevated temperatures.

As is best shown in FIG. 1, the outer cylindrical body member 23 is somewhat longer than the inner cylindrical body member 27. Further, the inner cylindrical body member 27 has a radially-inwardly tapered edge 31.

The window assembly of the lamp of the present invention, as shown in FIGS. 1 and 2, includes a disk-shaped window 35 having a circular periphery and a diameter more or less approximating the inside diameter of the first cylindrical body member 23. In practice, the window 35 is typically formed of sapphire and is about one-eighth inch thick. The window assembly further includes a tubular cowling member 37 with open circular ends, one smaller than the other. More particularly, the ends of the cowling member may be described as right cylindrical sections. The smaller open end of the cowling member 37 is dimensioned to snugly receive the circular window 35 to hold the window in a position in a plane perpendicular to the axial center line of the lamp. The larger open end of the cowling members 37 is dimensioned to receive the end of the first cylindrical body member 23; accordingly, the outside diameter of the cylindrical body member 23 is approximately equal to the inside diameter at the larger end of the cowling member 37. In the preferred embodiment, the transition region between the smaller and larger open ends of the cowling member 37 is a flaring section having a generally frustro-conical shape. In practice, the cowling member is metal, such as Kovar, which is relatively pure and able to closely match the thermal expansion rates of the ceramic body and the sapphire window.

The window assembly of the lamp of the present invention further includes a ring-shaped retaining member 40 which is dimensioned to fit snugly within the smaller right cylindrical end portion of the cowling member 37. The purpose of the retaining member 40 is to support the window 35. In practice, the retaining member 40 is formed of a metallic material similar to that of the cowling member, so that the two may be readily brazed together.

Still further, the window assembly includes radially extending strut members 43 which, in the preferred embodiment, are generally V-shaped and of substantial width so that, in assembled condition, the ends of the strut members can be attached to the ring-shaped retaining member 40 and so that the apex of the struts is approximately at the axial center line "A" of the lamp. Typically, two such V-shaped strut members are provided. In practice, the strut members are formed of an electrically conductive metallic material capable of withstanding the high temperature generated within the lamp.

The strut members support one end of an elongated cathode member 47. In practice, the cathode member 47 is typically rod-shaped and its distal end is tapered to form a tip 49. The length of the cathode member is such that the tip 49 extends essentially to the focal point of the lamp.

The reflector assembly of the lamp of the present invention comprises a hollow concave reflecting shell 53. The reflecting shell is dimensioned such that its mouth has a diameter which approximately equals the inside diameter of the outside cylindrical body member 23. The interior or reflecting surface of the shell 53 may be parabolic, eliptical or aspherical in shape. In practice, the reflecting shell is formed of a ceramic material such as alumina AD 94.5, and its concave reflecting surface is normally coated with a reflective metal material. An aperture 57 is formed centrally through the apex end of the reflecting shell (i.e., through the concave end opposite the mouth of the shell).

At this juncture, it should be noted that the tapered edge 31 of the inner cylindrical member 27 has an angle which is substantially conforming, or tangent, to the convex wall of the reflecting shell 53.

The anode in the illustrated embodiment comprises a rod-shaped member 61 whose one end is sealingly fitted through the central aperture 17 in the base member 15. The opposite end of the anode member 61 comprises a relatively enlarged head portion 63. The anode member 61 extends axially of the lamp such that the head portion 63 is approximately at the focal point of the lamp, but spaced slightly from the tip 49 of the cathode member 47. The distance between the head portion 63 of the anode member 61 and the tip 49 of the cathode member 47 defines the arc gap of the lamp. In practice, the arc gap typically ranges in length from about 0.025 inches to about 0.075 inches.

The lamp of the present invention includes a spacer ring 67 whose outside diameter approximately equals the inside diameter of the cylindrical body member 23. Although the spacer member 67 has substantial thickness, it need not be as radially thick as the second cylindrical body member 27. In practice, the spacer member 67 is formed of a dielectric material to provide electricl insulation.

Figure 3:
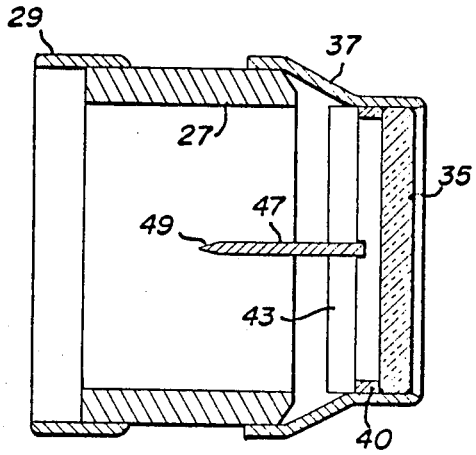
FIG. 3 is a side view of a portion of the lamp of FIG. 1.

A particular advantage of the above described lamp is that it can be readily assembled. In practice, the components shown in FIG. 3 are fitted together and then secured to one another by brazing in a single braze step. In other words, in one operation, the window assembly (including the window 35, the cowling member 37, the retaining ring 40, the struts 43 and the cathode member 47) can all be fixed to one another and to the outer cylindrical body member 23. In practice, it is preferable to also fix the band 29 to the base end of the cylindrical body member in the same braze.

After the first braze, assembly of the lamp proceeds by inserting the dielectric spacer ring 67 into the open base end of the outer cylindrical body member 23 until the ring abuts the struts 43. Next, the concave reflecting shell 53 is inserted into the outer cylindrical body member 23 and positioned such that the edge of its mouth rests upon the dielectric spacer ring 67. Next, the inner cylindrical body member 27 is inserted into the outer cylindrical body member so that its tapered edge 31 abuts the convex side of the reflector shell 53 and, thereby, holds the reflector shell snugly in position. Finally, the disk-shaped base member 15, including the anode member 61, is fitted onto the open end of the outer tubular member 23. At this time, the assembly of the lamp is essentially complete and the lamp can be sealed with a simple braze or weld of the band 29 to the outer periphery of the base member 15.

After assemblage of the lamp is complete, pressurized gas, typically xenon, can be introduced into the lamp via a tubulation 71. After the lamp is filled with pressurized gas, the tubulation 71 is permanently sealed off. Thereafter, the lamp is ready for operation.

Although the present invention has been described in terms of the presently preferred embodiment, it is to be understood that such disclosure is not to be interpreted as limiting. Various alternations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A process for assembling a lamp of the short arc type comprising the steps of:

(a) positioning a circular window within a window section of an open-ended tubular cowling member having a window section with an inside diameter approximately equal to the outside diameter of said circular window to receive said window and flaring radially outward to a body section;

(b) positioning a first end of a first hollow cylindrical body member within said body section, with the inside diameter surface of said body section abutting the outside diameter surface of said first body member;

(c) positioning a window retaining ring, having a diameter approximately equal to that of said circular window, concentrically within said window section of the cowling member with a first edge of said window retaining ring abutting said window to sealingly secure said circular window in place;

(d) positioning a strut means against a second edge of said window retaining ring with said strut means extending radially inward from the window retaining ring and with said strut means positioned between the window and body sections of said cowling member;

(e) positioning a cathode member on said strut means to extend axially from said strut means in a direction opposite said circular window;

(f) brazing together, in a single braze step, said window, said cowling member, said window retaining ring, said strut means, said cathode member, and said first body member;

(g) inserting within said first body member a reflecting shell retaining ring having an outside diameter approximately equal to the inside diameter of said first cylindrical body member, said reflecting shell retaining member having a first edge abutting said strut means and being mounted partially within said first cylindrical body member at the first end thereof;

(h) inserting inside the first body member a hollow concave reflecting shell having a mouth and dimension to fit completely within said first cylindrical body member with the outer edge of said concave member positioned against a second edge of said reflecting shell retaining ring, and with an aperture formed therethrough opposite its mouth;

(i) inserting inside the first cylindrical body member a second hollow cylindrical body member having a length less than the first body member, and positioned to fit flush concentrically within the first body member, the second body member having a radially tapered edge at a first end abutting the periphery of the outer walls of said concave shell to secure the reflecting shell concentrically in place between said reflecting shell retaining ring and said second body member;

(j) attaching an anode member on a disk shaped base dimensioned to sealingly enclose a second end of said first body member and a second end of said second body member, and with said anode member dimensioned and positioned to extend axially through said central aperture in said hollow concave reflecting shell to a location spaced adjacent the end of said cathode member at the focal point of said reflecting shell; and (k) sealingly attaching said disk member to the second end of the first body member and the second end of the second body member.

* * * * *